US005825392A

United States Patent [19]

Mochizuki

[11] Patent Number: 5,825,392

[45] Date of Patent: Oct. 20, 1998

[54] RECORDING DEVICE HAVING DETACHABLE PRINTING HEAD

[75] Inventor: Tatsuo Mochizuki, Yamanashi-ken, Japan

[73] Assignee: NISCA Corporation, Yamanashi-Ken, Japan

[21] Appl. No.: 747,955

[22] Filed: Nov. 12, 1996

[30] Foreign Application Priority Data

Nov. 13, 1995 [JP] Japan ..... 7-294110

[51] Int. Cl.[6] ..... B41J 29/02

[52] U.S. Cl. ..... 347/197; 347/222; 400/693; 400/690.4; 400/175

[58] Field of Search ..... 347/197, 198, 347/222, 108; 400/120.18, 120.17, 175, 690.4, 692, 693

[56] References Cited

U.S. PATENT DOCUMENTS 4,646,111 2/1987 Shimosato et al. ..... 347/32

5,044,801 9/1991 Uchimura et al. ..... 400/692

*Primary Examiner*—N. Le
*Assistant Examiner*—Anh Vo
*Attorney, Agent, or Firm*—Kane,Dalsimer,Sullivan,Kurucz, Levy, Eisele and Richard, LLP

[57] ABSTRACT

A head holder incorporating a thermal printing head is detachably mounted in a printing position defined in a thermal transfer printer by use of guide means. The head holder secured by the guide means is vertically moved by means for vertically moving the head holder so as to be positioned at a stand-by point in non-operation of printing, and at a print working point in operation of printing. When the head holder demounted for exchanging or other possible purposes is replaced in the printing position, the head holder is restrained by lateral and longitudinal spring members, thus being placed in an adequate printing position, so as to enable excellent printing on a recording medium such as ID cards to be successfully performed without marring the essential printing quality.

8 Claims, 8 Drawing Sheets

37
31
1a
38b
38
38a
30
37
1
31
10
32b
50
X
PP
34
C
60

RECORDING DEVICE HAVING DETACHABLE PRINTING HEAD

BACKGROUND OF THE INVENTION

1. Field of the Invention

This invention relates to a printer for printing letters, figures, photographs and the like on various recording mediums such as an ID card with monochromatic or multicolor thermal transfer inks, and more particularly, to a thermal transfer printer having a detachable thermal printing head so as to conveniently exchange the printing head and easily maintain the printer.

2. Description of the Prior Art

There have been so far variety of printers for printing visible information such as letters, figures and photographs on at least one surface of a recording medium information card such as plastic cards of ID (identification) cards and credit cards, and IC cards with monochromatic or multicolor thermal transfer inks.

In general, the thermal transfer ink applied onto an elongated ribbon base is thermally transferred to the surface of the information card by selectively driving numerous heating elements arrayed on a thermal printing head.

The thermal printing head which moves relative to the thermal transfer ink ribbon while bringing the ink ribbon into contact with the information card to be forwarded in printing operation has a contact face coming in touch with the ink ribbon, which is usually coated with glass. Thus, the printing head is fragile and easy to wear and break, and often interferes with the printing operation due to stains sticking to the head.

However, in a conventional thermal transfer printer of this type, the thermal printing head is commonly secured on a printer frame body so as to stabilize the structure and printing operation and achieve precision in printing. There is a printer having a thermal printing head attached to a movable lid member capable of opening and closing for performing maintenance of the printer and exchanging an ink ribbon (cf. U.S. patent application Ser. No. 08/329,197, filed Oct. 26, 1994).

Therefore, when encountering such troubles as described above in the conventional printer, the work of repairing or exchanging the printing head is difficult or impossible. Even if the malfunctioning printing head can be exchanged, a highly skilled technique is required for accurately placing an alternative printing head in its adequate position, and still, the printing head can not precisely be oriented in position, consequently entailing the risk of deteriorating printing quality.

OBJECT OF THE INVENTION

An object of the present invention is to provide a thermal transfer printer capable of easily mounting and demounting a thermal printing head so as to conveniently exchange the printing head and perform maintenance of the printer with ease.

Another object of the present invention is to provide a thermal transfer printer in which the thermal printing head can steadily and stably placed in the adequate position so as to successfully perform the printing operation.

Still another object of the present invention is to provide a thermal transfer printer capable of arbitrarily adjusting the inclination of the detachable thermal printing head.

Yet another object of the present invention is to provide a thermal transfer printer capable of facilitating exchanging of the thermal printing head so as to maintain the excellent printing performance and enable the printer to be prolonged in use.

SUMMARY OF THE INVENTION

To attain the objects described above according to this invention there is provided a thermal transfer printer comprising a thermal printing head, a head holder for the printing head, guide means for placing the head holder to a printing position, and means for vertically moving the printing head held in the printing position in time to the printing operation.

The guide means has a pair of rail members opposite to each other for movably supporting both sides of the head holder incorporating the printing head, and holder catch members movable along the rail members and urged upward by spring means.

The head holder placed in the printing position is retained by the holder catch members so as to assume its upper stand-by point in non-operation of printing, and be moved down to its lower print working point, to press the transfer ink ribbon against a platen roller while printing. The transfer ink is thermally transferred to the surface of the card by selectively heating the heating elements of the printing head as the card is moved by the platen roller while pressing the ink ribbon against the card, consequently to form desired images on the surface of the card.

The head moving means is secured to a lid member which is pivotally disposed on a housing of the printer and can be opened upward so as to take out the transfer ink cartridge for exchanging, so that the printing head can be released from the pressing force of the head moving means only by opening upward the lid member and the head holder can be demounted from the printer along the guide means with the ink cartridge.

One of the rail members of the guide means is provided with a lateral spring member such as a plate spring for elastically urging the head holder in the lateral direction perpendicular to a card forwarding direction. Further, there are disposed longitudinal spring members each having an elastic inclined plane with which the head holder comes into contact when arriving at the lower print working point, thus being elastically urged in the card forwarding direction. With the lateral and longitudinal spring members, the head holder can be placed in the adequate printing position.

Other objects and features of the present invention will be hereinafter explained in detail with reference to the accompanying drawings.

DESCRIPTION OF THE PREFERRED EMBODIMENTS

This invention is related to a detachable structure for a thermal printing head used in a thermal transfer printer, which is suitable specifically for printing images such as letters, figures and photographs on plastic cards such as ID cards or IC memory cards with thermal transfer ink. However, these information cards should not be understood as limitative, because the present invention is applicable for printing on various types of recording media. One embodiment of the invention will be described hereinafter with reference to the accompanying drawings.

Figure 1:
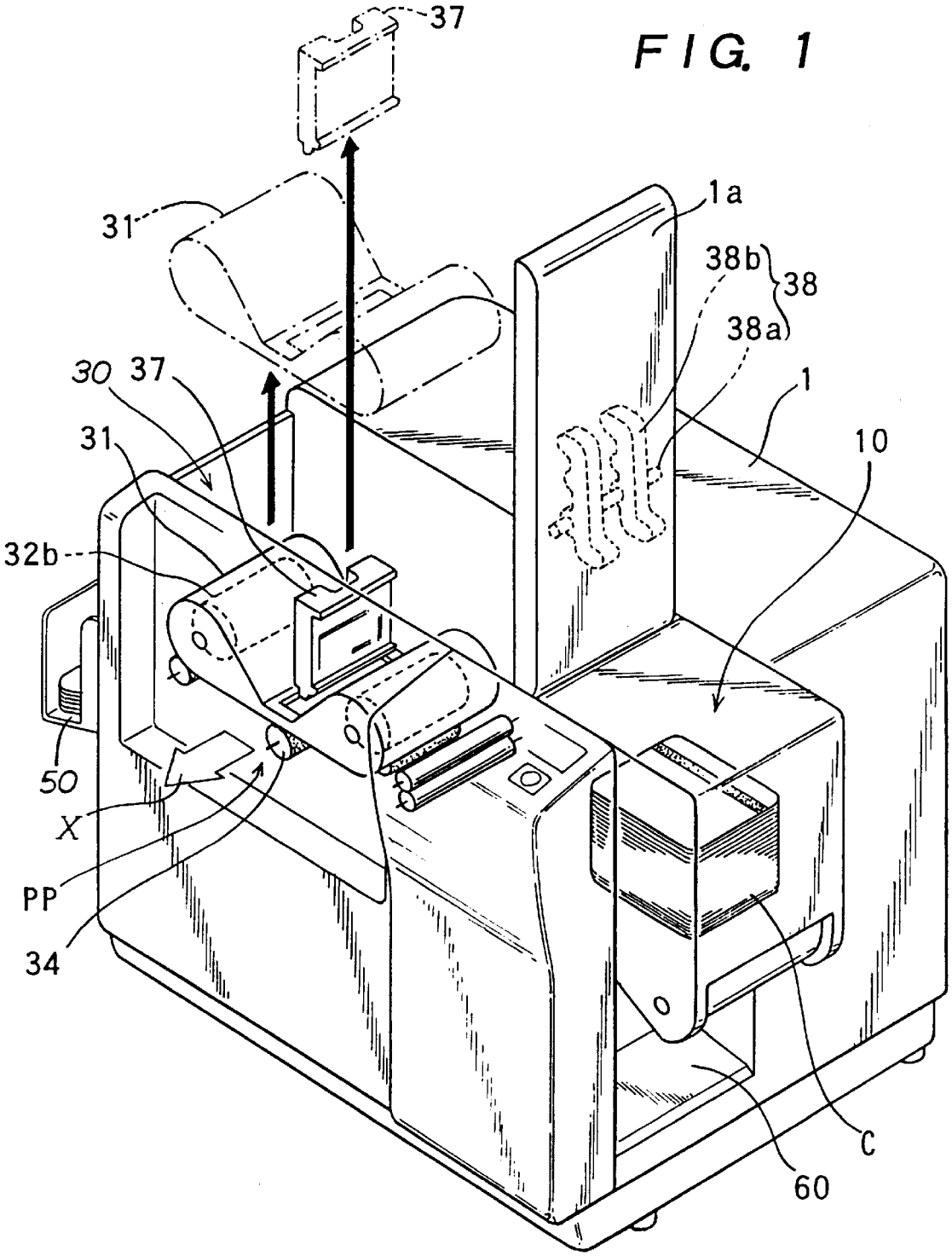
FIG. 1 is a schematic perspective view showing one embodiment of a thermal transfer printer according to this invention.
Figure 2:
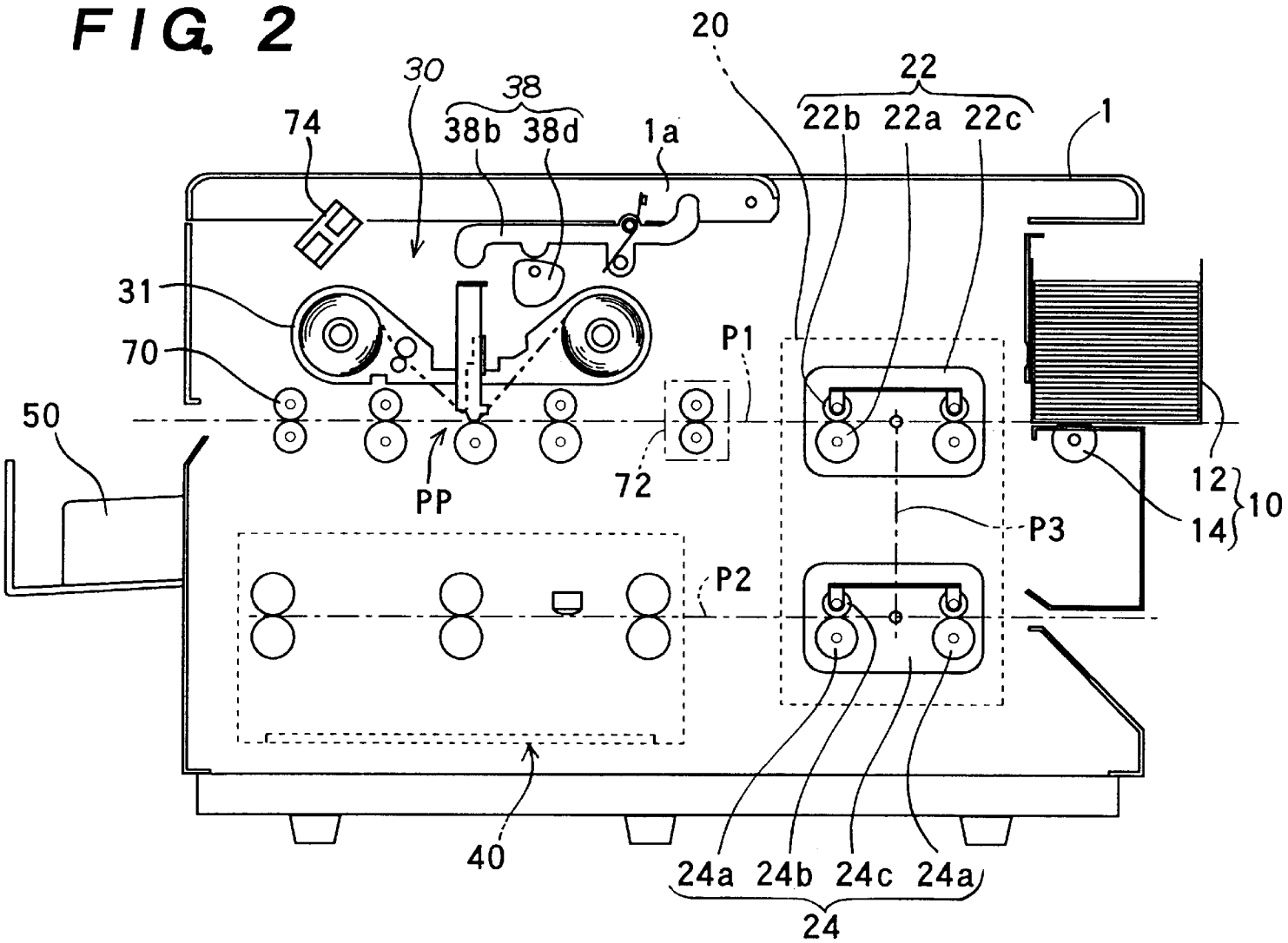
FIG. 2 is a front view schematically showing the interior of the printer of FIG. 1.

As illustrated in FIG. 1 and FIG. 2, the thermal transfer printer according to this invention comprises a card supply portion 10 disposed on one side of a printer housing 1, a card transfer portion 20 having a card transferring unit 22 capable of transferring and turning over a card C fed from the card supply portion 10, and a printing portion 30 for printing images such as letters and photographs on at least one surface of the card C fed through the card transfer portion 20.

In the card printer of this embodiment, the card supply portion 10, card transfer portion 20 and printing portion 30 are arranged along a first feeding path P1. Under the first feeding path P1, there is defined a second feeding path P2 in parallel to the first feeding path P1. On the second feeding path, there is arranged a recording portion 40 including a magnetic encoder or IC memory reader/writer for writing desired information data to a magnetic stripe formed on the information card C or a built-in IC memory. In order for sending the information card C to the recording portion 40, a supplementary transferring unit 24 is disposed on the second feeding path P2 under the card transferring unit 22 of the card transfer portion 20.

The card supply portion 10 includes a card stacker 12 for stacking a plurality of blank cards C, and a kick roller 14 which is mounted on the bottom of the card stacker 12. Thus, the lowermost of the cards stacked in the card stacker 12 can be sent out by rotating the kick roller 14.

Formed on the side opposite to the card supply portion 10 is a card discharge portion 50 on the printer housing 1. In the illustrated embodiment, a reject portion 60 for accumulating faulty cards is formed under the card supply portion 10 on the second feeding path P2.

The card transferring unit 22 and supplementary transferring unit 24 respectively comprise paired transferring rollers 22*a* and 24*a*, press rollers 22*b* and 24*b* coming into press contact with the transferring rollers 22*a* and 24*a*, and rotary frames 22*c* and 24*c* for rotatably supporting the transferring rollers 22*a* and 24*a* and press rollers 22*b* and 24*b*.

The card C fed from the card supply portion 10 into between the transferring rollers 22*a* and the press rollers 22*b* of the transferring unit 22 is sent into the printing portion 30 by rotating the rollers 22*a* and 22*b*. Then, the card C is subjected to printing on its upper surface there.

By turning the rotary frame 22*c* with the card C held between the rollers 22*a* and 22*b* one-half of a rotation, the card C is turned upside down, thus to be subjected to printing on its reverse surface in the printing portion 30.

When the card C is required to be sent from the transferring unit 22 into the second feeding path P2 through the transferring unit 24, the rotary frame 24*c* is turned one-fourth of a rotation with the card C held between the transferring rollers 22*a* and press rollers 22*b*, thus causing the card to assume its vertical posture. At this time, the rotary frame 24*c* is revolved one-fourth of a rotation, so that the card C can be transferred from the transferring unit 22 to the transferring unit 24 by rotating the rollers 22*a* and 22*b*. Thereafter, the card C sent to the transferring unit 24 is turned to assume its horizontal posture by revolving the rotary frame 24*c* one-fourth or three-fourth of a rotation, and then, sent to the recording portion 40.

Upon writing the desired information data to the card C in the recording portion 40, the card is sent back to the first feeding path P1 through the transferring unit 24 and the transferring unit 22 in the reverse order.

Although the card C is verified on written data thereon in the recording portion 40, when a faulty card causing a write error is found as the result of verification, it is discharged to the reject portion 60 through the transferring unit 24.

The printing portion 30 includes a ribbon cartridge 31 containing the thermal transfer ink ribbon 32, paired capstan roller 33*a* and pinch roller 33*b* arranged on the first feeding path P1, a platen roller 34 on which a printing position PP is defined, paired capstan roller 35*a* and pinch roller 35*b*, a thermal printing head 36 held by a head holder 37 so as to be positioned in the printing position PP opposing to the platen roller 34, and means 38 for vertically moving the head holder 37 in time with the operation or non-operation of printing.

The ink ribbon 32 in the ribbon cartridge 31 is unwound from a supply roll 32*a* and wound on a winding roll 32*b*. For printing color images, an ink ribbon having ink frames applied with dye-sublimation type thermal transfer inks of different colors frame by frame may be suitably used. For printing two-gradation images such as letters, an ink ribbon applied with thermal wax-transfer printing ink may be suitably used.

Incidentally, the recording portion 40 including a magnetic encoder is disposed under the printing portion 30 in the embodiment of FIG. 2 by way of example. However, a second printing portion using printing ink of different type from that used in the aforesaid printing portion 30 may be employed instead of the recording portion 40. For instance, it is optional to perform printing with dye-sublimation type thermal transfer ink in the printing portion 30 and printing with thermal wax-transfer printing ink in the second printing portion in place of the recording portion 40.

The ribbon cartridge 31 can be loaded into and unloaded from the printing position PP of the printing portion 30 by opening a lid member 1*a* pivotally mounted on the upper side of the printer housing 1. Otherwise, the ribbon cartridge 31 may be inserted into and taken out from the printer through the front side of the printer as indicated by the arrow X in FIG. 1.

Figure 3:
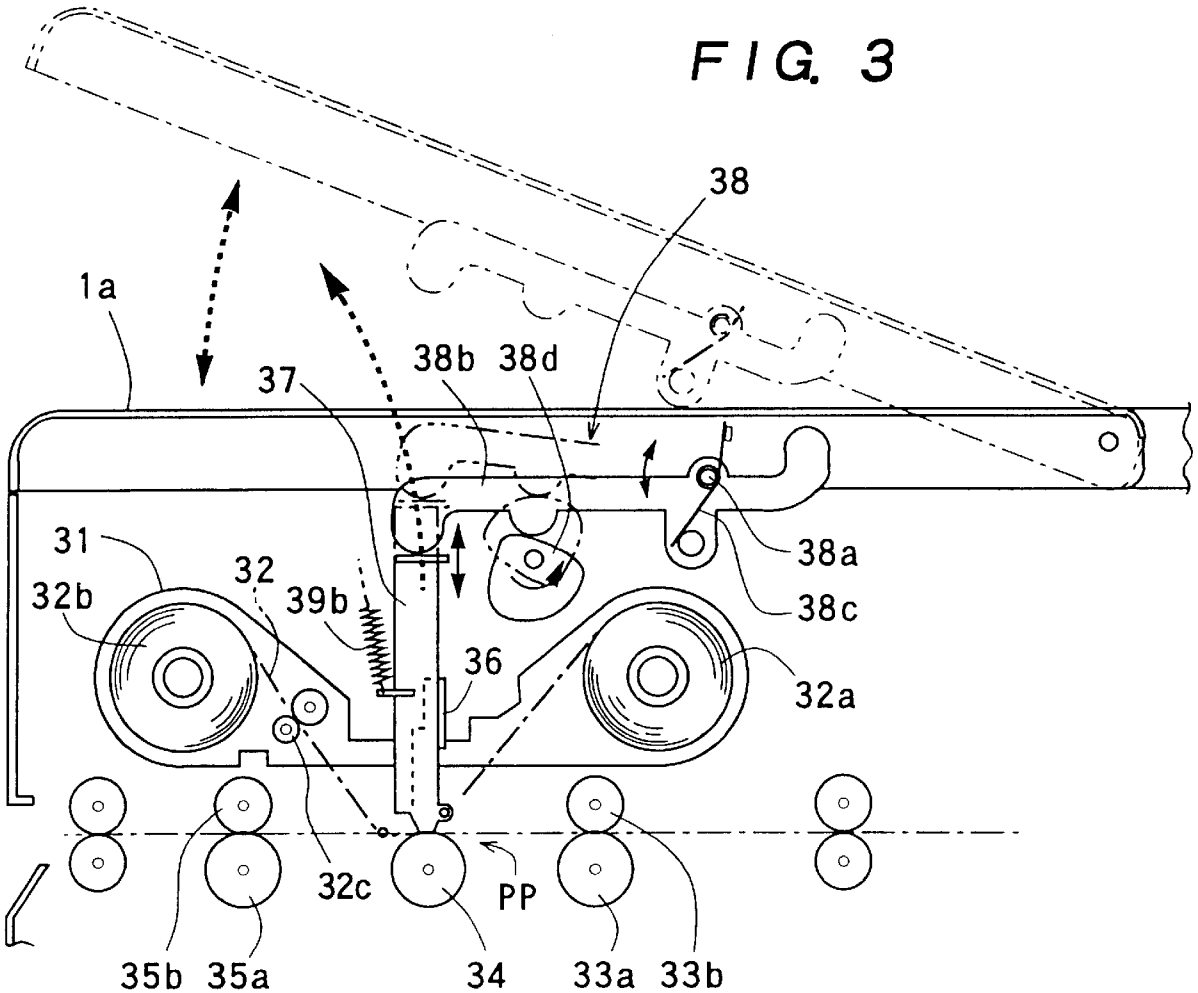
FIG. 3 is a front view schematically showing in part the printing portion of the printer of FIG. 1.

Rollers 32*c* shown in FIG. 3 is disposed for carrying the ink ribbon to wind the ink ribbon to the winding roll 32*b*.

The thermal printing head 36 is provided on its leading end (lower end in the drawing) with an array of heating elements. By selectively driving the heating elements to be heated while causing the printing head to bring the ink-coated face of the ink ribbon 32 into contact with one surface of the card C, the ink applied to the ink ribbon 32 is thermally transferred to the surface of the recording medium card. Thus, by continuously feeding the card and ink ribbon synchronously in the card forwarding direction while controlling the heating operation of the heating elements of the printing head, the desired images can be reproduced on the card.

The head holder 37 incorporating the thermal printing head 36 in position is detachable from the printing position PP defined above the platen roller 34 by guide means 39 secured on an internal frame 2 in the printer housing 1.

The head holder 37 is provided on its both lateral side brims with guide wheels 37*d* arranged one over another for ensuring the smooth vertical movement of the holder along the guide means 39.

The guide means 39 comprises a pair of rail members 39*a* having grooves opposed to each other for receiving the guide wheels 37*d* of the head holder 37 so as to vertically guide the head holder, and holder catch members 39*c* urged upward by springs 39*b* and movable vertically along the rail members 39*a*.

Figure 4:
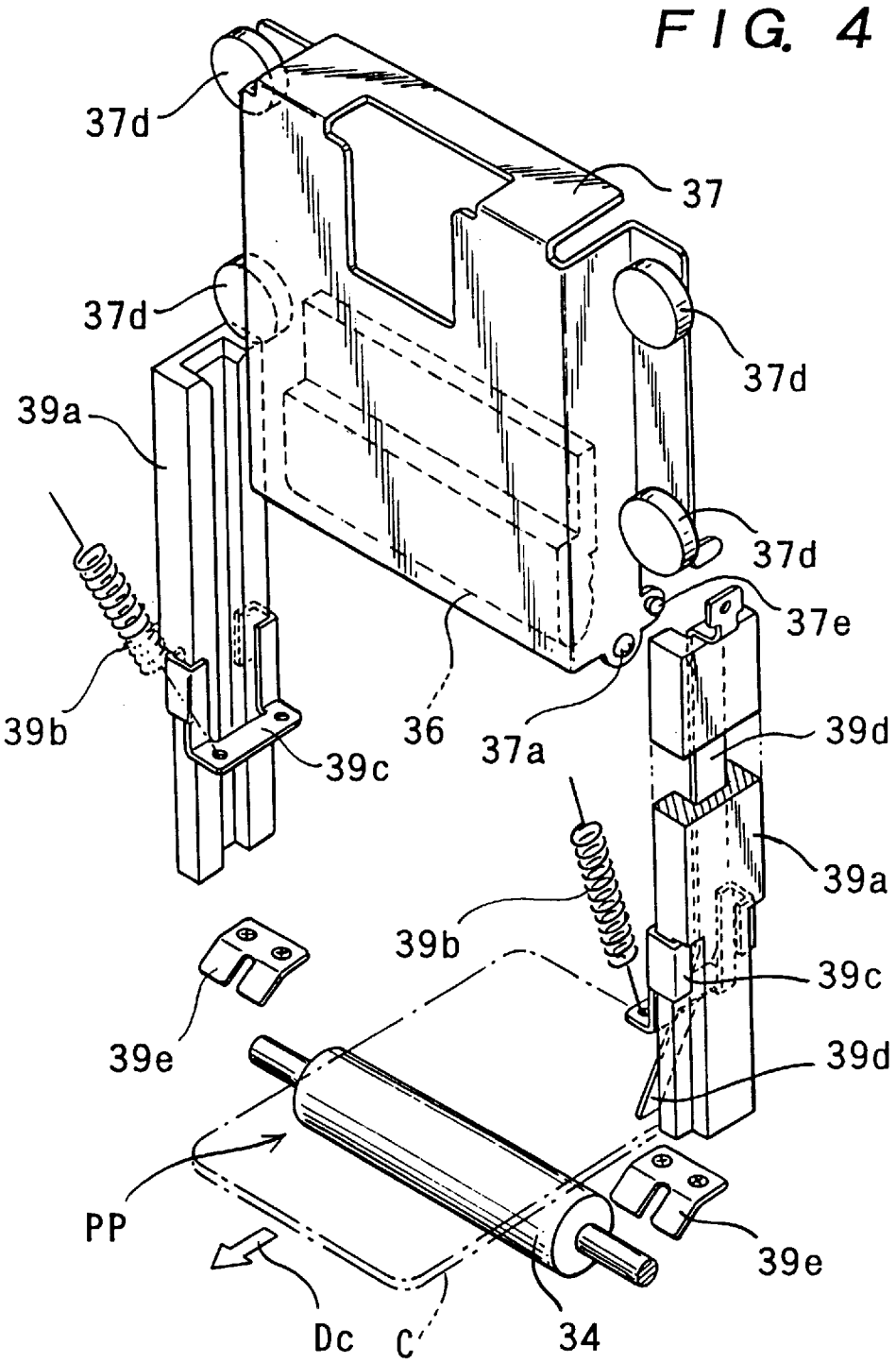
FIG. 4 is a schematic perspective view showing the state of introducing the head holder into the printing position defined between the guide means in the printer of FIG. 1.
Figure 5:
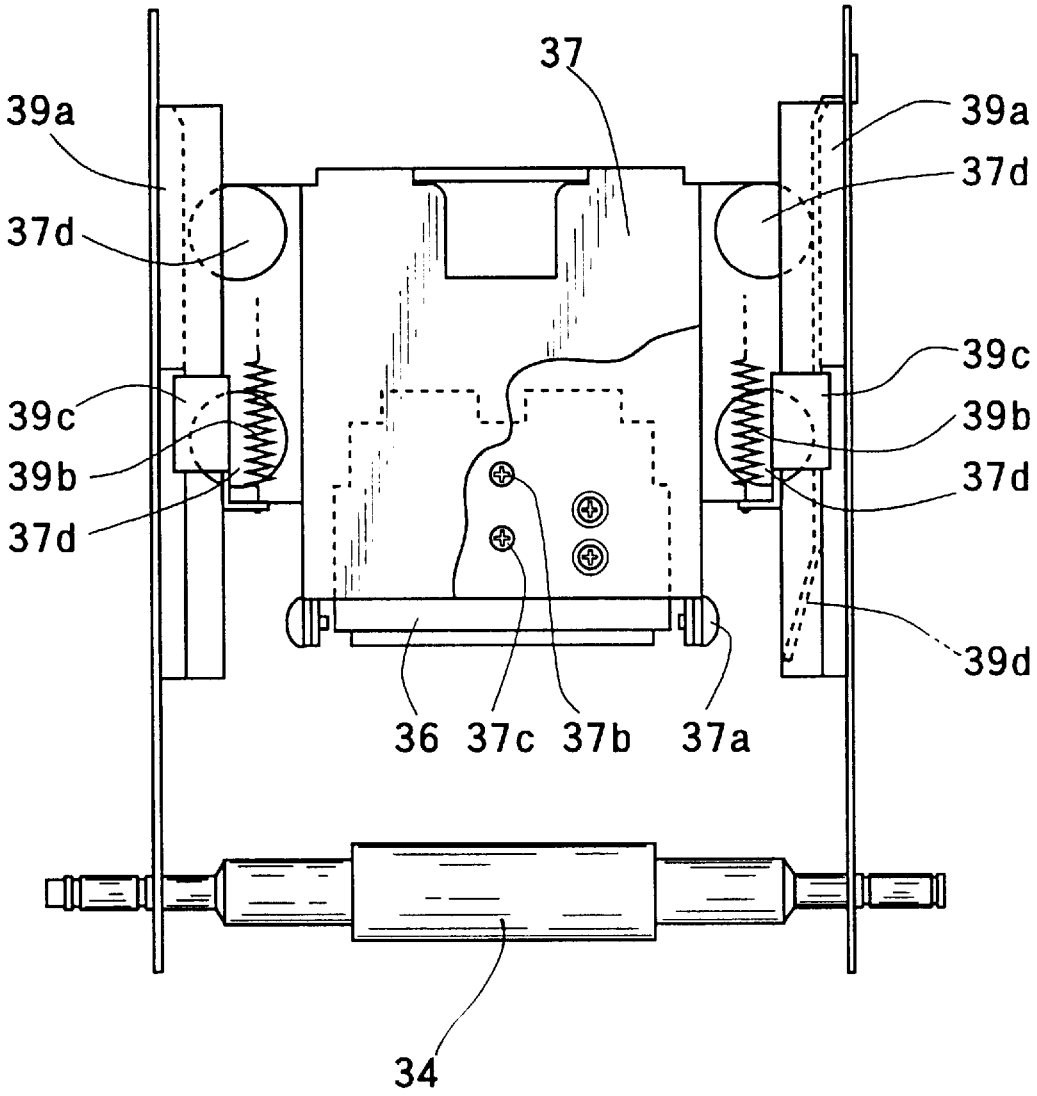
FIG. 5 is a schematic front view showing the state of placing the head holder in the printing position.

The holder catch member 39*c* is permitted to vertically move within the range defined between a lower print working point Pw at which the thermal printing head 36 is positioned while printing and an upper stand-by point Ps at which the printing head is positioned in non-operation of printing. The vertical movement of the holder catch member is restricted by forming grooves in the lower portion of the rail member 39*a* in part as shown in FIG. 4, or using any other adequate stopper. Therefore, by arbitrarily determining where the restricting grooves are formed or the stoppers are disposed, the limits within which the printing head 36 is allowed to move vertically can be defined arbitrarily.

Thus, the head holder 37 retaining the printing head is vertically moved with the guide wheels 37*d* guided by the opposed grooves formed in the rail members 39*a* of the guide means 39 in time with the printing operation.

In the groove formed in one of the rail members 39*a*, there is fitted a lateral spring member 39*d* such as a plate spring for elastically urging the head holder 37 against the other rail member in the lateral direction perpendicular to the card forwarding direction Dc. With this spring member, the head holder 37 is steadily placed in the lateral basic position defined by one of the rail members 39*a*.

The head holder 37 is provided at its lower end portion with guide pins 37*e* which come into collision with elastic inclined planes of spring members 39*e* when the head holder 37 arrives at the lower print working point Pw in printing operation. With the spring members 39*e*, the head holder 37 positioned at the print working point Pw is elastically urged in the card forwarding direction.

Accordingly, the head holder 37 is forcibly urged by the lateral spring member 39*d* and spring members 39*e* in the respectively defined directions, and thus, it can be stably positioned at the adequate print working point Pw while printing. Furthermore, the head holder 37 incorporating the printing is head 36 can be easily detached from the printing position PP along the guide means 39.

In the aforementioned manner, the thermal printing head 36 positioned at the lower print working point Pw in printing operation comes into press contact with the surface of the card C through the ink ribbon 32.

The vertically moving means 38 for restraining the printing head 36 at the print working point Pw in printing operation is secured onto the lid member 1*a* of the printer housing 1, so that the head holder 37 can recede and the ink cartridge 31 can be taken out from the printing position PP by opening the lid member 1*a* with ease as shown in FIG. 1.

The vertically moving means 38 for the thermal printing head includes a rocking lever 38*b* pivotally supported by an axial pin 38*a* on the lid member 1*a* and having a free tip end serving as the point of application which comes in contact with the head holder 37, a spring 38*c* for forcibly rotating the rocking lever 38*b* in one direction so as to forcibly urge the free tip end point of the rocking lever downward, a rotary cam 38*d* for rotating the rocking lever 38*b* against the spring 38*c*, and a rotary drive means 38*e* including a motor for rotating the rotary cam 38*d*.

By closing the lid member 1*a* upon setting the head holder 37 in the printing position PP, the point of application defined at the free tip end of the rocking lever 38*b* comes into contact with the upper face of the head holder 37.

The spring 38*c* mounted on the rocking lever 38*b* is made stronger in elasticity than the spring 39*b* for urging the head holder 37 upward, so as to urge the head holder 37 is depressed downward against the spring 39*b* when bringing the rocking lever 38*b* into press contact with the upper face of the head holder 37. However, the rocking lever 38*b* is pushed upward by the major diameter part of the rotary cam 38*d* in non-operation of printing, as a result of which depressing force produced by the rocking lever 38*b* is not exerted on the head holder 37, thus keeping the head holder 37 at the upper stand-by point Ps in the printing position PP (the state indicated by the solid line in FIG. 6).

Thus, the thermal printing head 36 of the head holder 37 is placed in the printing position PP by the vertically moving means 38 when closing the lid member 1*a*, and it can be released from the printing position PP when opening the lid member 1*a*.

In the illustrated embodiment, although the spring 38*c* is a coil spring wound on the pin 38*a*, it may be of any type capable of urging downward the point of application at the tip end of the rocking lever 38*b*, e.g. a tension spring or a plate spring.

Figure 6:
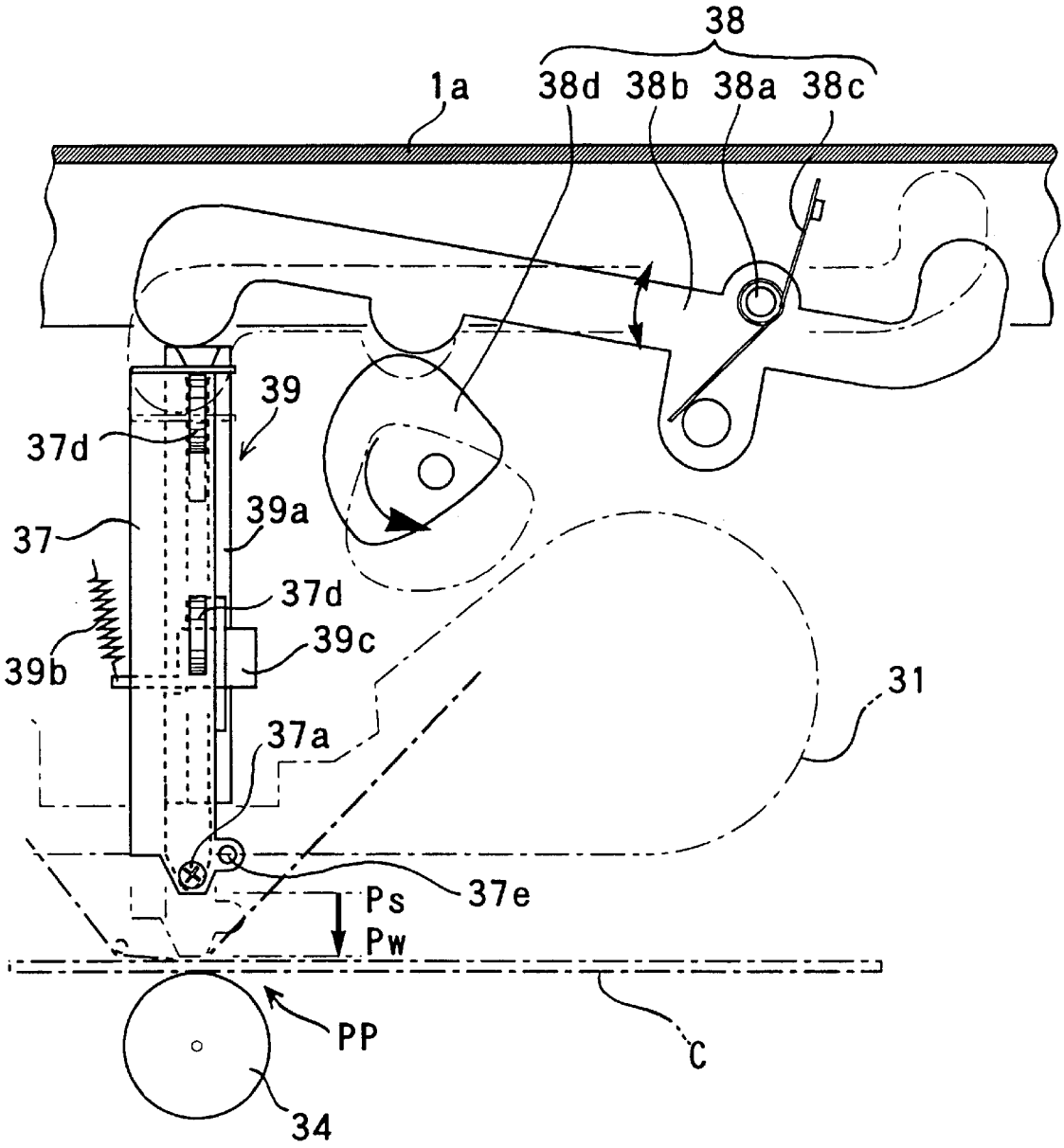
FIG. 6 is a schematic front view illustrating the operation of the means for vertically moving the head holder.
Figure 8:
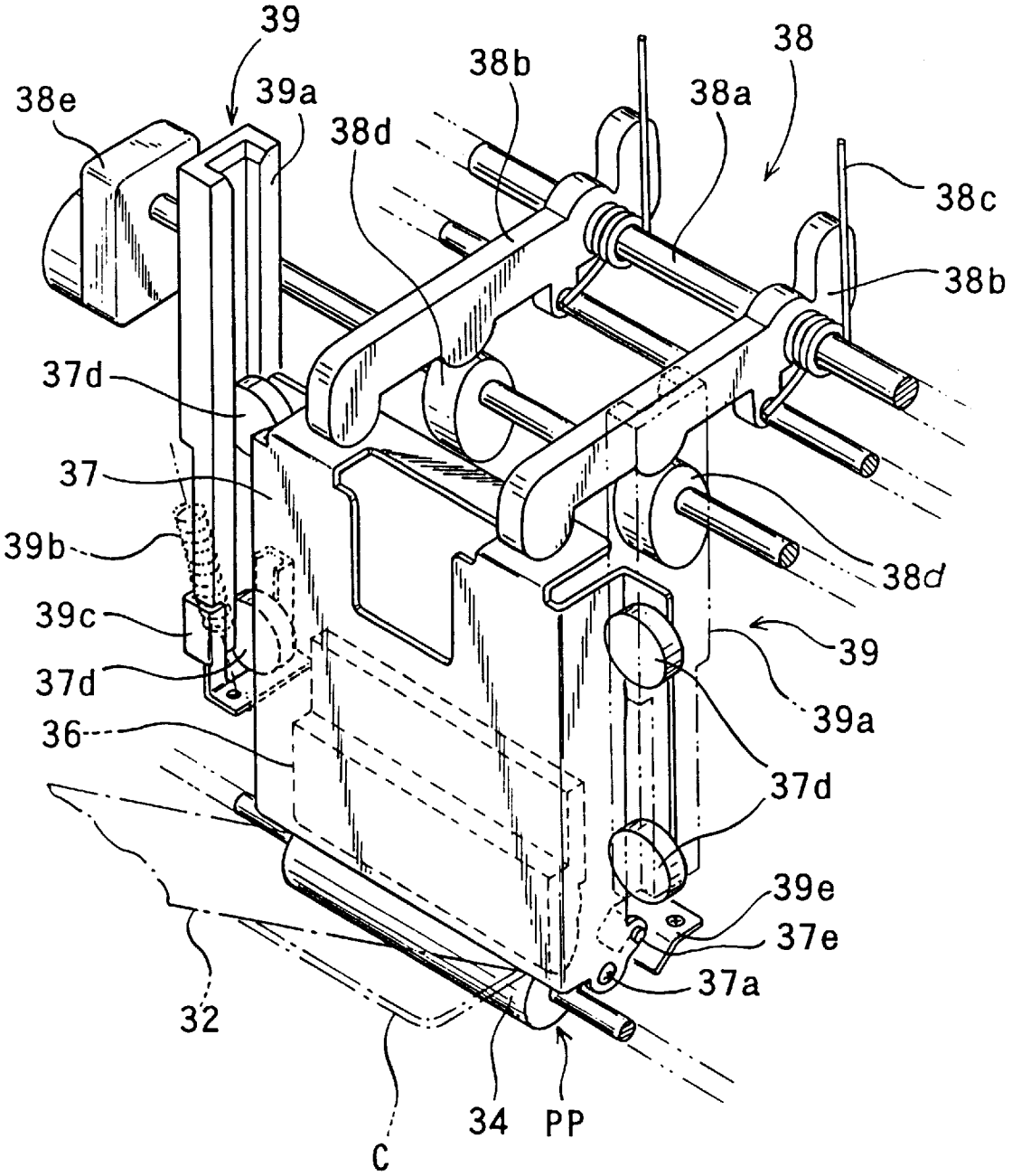
FIG. 8 is a schematic perspective view showing the state of the head holder in operation.
Figure 9:
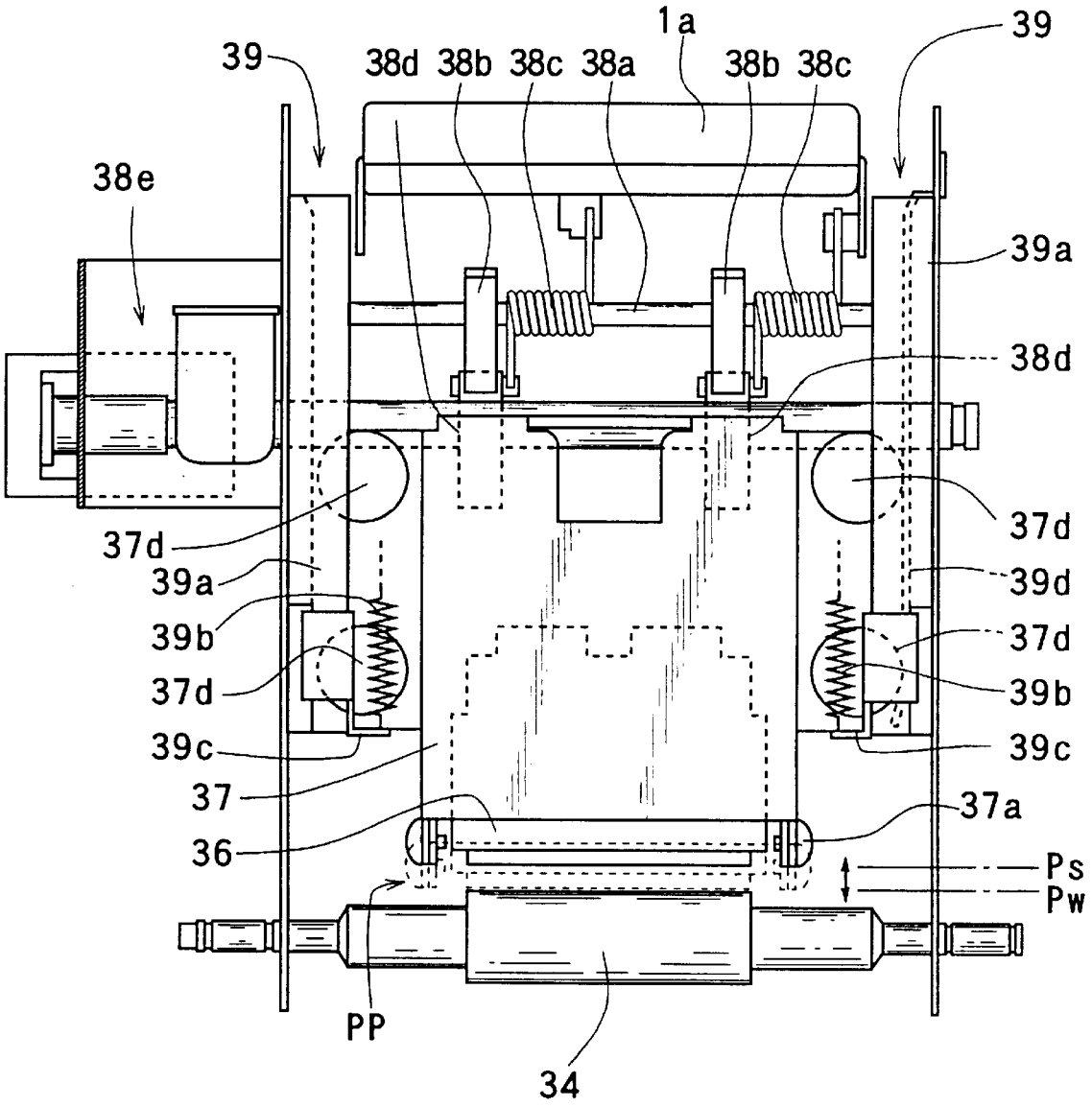
FIG. 9 is a schematic front view of the head holder positioned at the stand-by point.

At the commencement of the printing operation upon delivering the card C to the printing position PP, the rotary cam 38*d* rotates to bring the minor diameter part thereof into contact with the rocking lever 38*b* to rotate the rocking lever 38*b* about the axial pin 38*a*, thus depressing the head holder 37 against the spring 39*b* (the state indicated by the imaginary line in FIG. 6). As a result, the printing head 36 brings the thermal transfer ink ribbon 32 into contact with the card C, so as to carry out the printing operation.

Figure 7:
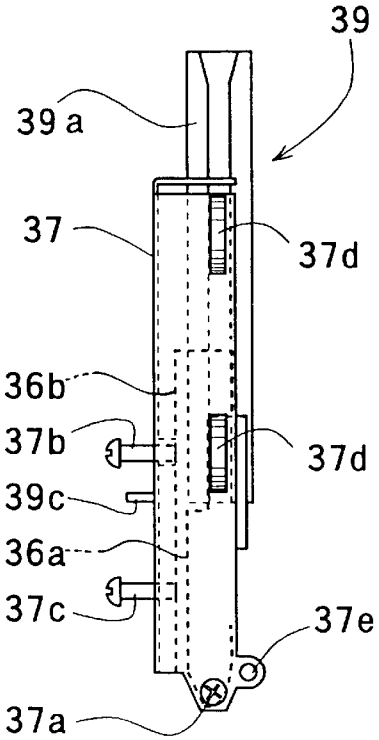
FIG. 7 is a schematic side view of the head holder.

The thermal printing head 36 in the head holder 37 has a head body 36*a* held by a mount frame 36*b* as shown in FIG. 7. The mount frame 36*b* is sustained on the lower end portion of the head holder 37 by a fixing pin 37*a*, and on the front side wall of the head holder 37 by an adjusting screw 37*b* and an attachment screw 37*c* so that the position of the printing head can be adjusted and fixed. By adjusting the fixing pin 37*a*, adjusting screw 37*b* and attachment screw 37*c*, the thermal printing head 36 can be decomposed and arbitrarily adjusted in posture (position and inclination relative to the platen roller 34).

In FIG. 2, reference numeral 70 denotes paired rollers disposed beyond the capstan roller 35*a* for sending out the finished card to the card discharge portion 50. Reference numeral 72 denotes cleaning means composed of a pair of cleaning rollers for cleaning the surface of the card C. Reference numeral 74 denotes a cooling fan for the printer. These elements are not indispensable for this invention, and therefore, may be optionally used in the printer of the invention.

As is apparent from the foregoing description, the printer according to the present invention has the thermal printing head easily detachable from the printing position so as to conveniently exchange the printing head and perform maintenance of the printer with ease. Furthermore, since the thermal printing head of the invention can steadily and stably placed into the adequate position, so that the excellent printing operation can be successfully performed without marring the essential printing quality of the thermal transfer printer. Besides, the thermal transfer printer of the invention can arbitrarily adjusted the inclination of the detachable thermal printing head. Therefore, the printer of the invention brings about marked effects in that the excellent printing performance can easily be maintained and the service life thereof can be lengthened because the printing head can be exchanged. Moreover, it is needless to say that the printer of the invention is suitable for not only printers applicable for information cards such as ID cards, but also any other types of thermal transfer printers.

It is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

What is claimed is:

1. A thermal transfer printer for printing on a recording medium by use of a thermal transfer ink ribbon loaded in a printing position, said thermal transfer printer comprising:

thermal printing head for performing thermal transfer printing at the printing position;

a printer housing having a lid member being openable and closeable and containing said thermal printing head;

a detachable head holder for holding said printing head;

guide means for vertically guiding and placing said head holder in a printing position, said guide means being disposed inside said printer housing so as to permit said head holder to be detached from and attached into said printer housing in the open state of said lid member; and means for vertically moving said printing head placed in said printing position in time to printing operation.

2. The thermal transfer printer according to claim 1, wherein said head holder is provided with guide wheels, and said guide means is provided with rail members having grooves opposed to each other for receiving said guide wheels of said head holder so as to vertically guide said head holder, and holder catch members urged upward by springs and movable vertically along said rail members, whereby said head holder moves vertically along said grooves in said rail members so as to be selectively placed at a stand-by point or a print working point.

3. The thermal transfer printer according to claim 2, wherein said vertically moving means for said thermal printing head includes a rocking lever pivotally supported by an axial pin on said lid member and having a free tip end coming in contact with said head holder, a spring for forcibly urging said free tip end of said rocking lever downward, a rotary cam for rotating said rocking lever against said spring, and a rotary drive means for rotating said rotary cam, whereby said rocking lever is rotated against said spring by rotating said rotary cam so that said head holder is moved vertically in time with operation or non-operation of printing.

4. The thermal transfer printer according to claim 2, further comprising a lateral spring member fitted in said groove formed in one of said rail members of said guide means for elastically urging said head holder toward the other rail member.

5. The thermal transfer printer according to claim 2, further comprising longitudinal spring members with which said head holder comes into contact when arriving at said print working point to be elastically urged in one direction.

6. The thermal transfer printer according to claim 2, further comprising a lateral spring member fitted in said groove formed in one of said rail members of said guide means for elastically urging laterally said head holder, and longitudinal spring members for elastically receiving said head holder at said print working point, whereby said head holder is restrained in position.

7. A thermal transfer printer for printing on a recording medium by use of a thermal transfer ink ribbon loaded in a printing position, said thermal transfer printer comprising:

a thermal printing head for performing thermal transfer printing at the printing position;

a printer housing having a lid member being openable and closeable, said lid member being placed above said printing position;

a detachable head holder for holding a thermal printing head, which holder is detachably fitted to said printing position;

guide means for guiding and placing said head holder in said printing position, said guide means being disposed inside said printer housing so as to permit said head holder to be detached from and attached into said printer housing in the open state of said lid member; and means for vertically moving said head holder placed in said printing position in time with printing operation, said vertically moving means being secured onto said lid member;

wherein said head holder is positioned at a print working point by operating said vertically moving means for said head holder in the closed state of said lid member, and wherein said head holder is permitted to be released from said printing position when opening said lid member.

8. The thermal transfer printer according to claim 7, wherein said vertically moving means for said thermal printing head includes a rocking lever pivotally supported by an axial pin on said lid member and having a free tip end coming in contact with said head holder, a spring for forcibly urging said free tip end of said rocking lever downward, a rotary cam for rotating said rocking lever against said spring, and a rotary drive means for rotating said rotary cam, whereby said rocking lever is rotated against said spring by rotating said rotary cam so that said head holder is moved vertically in time with operation or non-operation of printing.

* * * * *